United States Patent [19]

Burke

[11] 3,959,833

[45] June 1, 1976

[54] COMBINATION MATTRESS, MATTRESS INSERT, AND COMMODE

[76] Inventor: William Burke, Burke Incorporated, P.O. Box 1064, Mission, Kans. 66222

[22] Filed: June 4, 1975

[21] Appl. No.: 583,623

[52] U.S. Cl. ..... 5/90; 5/91

[51] Int. Cl.[2] ..... A61G 7/02

[58] Field of Search ..... 50/90–93; 5/90

[56] References Cited

UNITED STATES PATENTS

| | | | |
|---|---|---|---|
| 1,525,605 | 2/1925 | Dry | 5/90 |
| 1,888,423 | 11/1932 | Comper | 5/90 UX |
| 2,116,171 | 5/1938 | Harris | 5/91 |
| 2,174,582 | 10/1939 | Hudon | 5/90 X |
| 2,537,906 | 1/1951 | Over | 5/90 X |
| 2,654,899 | 10/1953 | Yazcola | 5/91 |
| 2,932,831 | 4/1960 | Keathley et al. | 5/90 X |
| 3,129,438 | 4/1964 | Hall | 5/90 |
| 3,381,315 | 5/1968 | Glassberg | 5/90 X |
| 3,833,945 | 9/1974 | Moody | 5/91 |

FOREIGN PATENTS OR APPLICATIONS

| | | | |
|---|---|---|---|
| 503,952 | 3/1920 | France | 5/90 |
| 28,837 | 12/1912 | United Kingdom | 5/93 |

*Primary Examiner*—Paul R. Gilliam
*Assistant Examiner*—Andrew M. Calvert
*Attorney, Agent, or Firm*—Fishburn, Gold & Litman

[57] ABSTRACT

A combination mattress, mattress insert, and utility insert such as a basin, commode and the like for use with a hospital or invalid bed wherein the mattress has opposite side edge portions and walls extending from one of the side edge portions defining a recess positioned in an intermediate portion of the mattress to receive the mattress insert, commode or the like therein. The utility insert or commode is interchangeable with the mattress insert and is removably received in the recess in the mattress. The commode has a receptacle with an upstanding side wall and a removable seat portion supported on the receptacle side wall and having an opening therein for use. The invalid bed supports the mattress and one of the mattress insert and commode when same is positioned in the recess in the mattress and the bed is movable to different portions as between a first position having the mattress horizontal and a second chair-like position having a mattress first end portion inclined upwardly and a mattress second end portion inclined downwardly from the mattress intermediate portion.

6 Claims, 7 Drawing Figures

COMBINATION MATTRESS, MATTRESS INSERT, AND COMMODE

The present invention relates to a combination mattress, mattress insert and a utility insert, such as a commode, and more particularly to such a combination wherein the mattress insert and utility insert or commode are interchangeable and one being removably positioned in the recess in the mattress with the combination being particularly adapted for use by hospital patients, disabled persons, or invalids.

The principal objects of the present invention are: to provide a combination mattress, mattress insert, and utility insert, such as a commode, basin, and the like, and an adjustable mattress support structure particularly adapted for use by disabled persons, invalids, or hospital patients; to provide such a combination wherein the mattress has a recess extending from one side edge portion of an intermediate portion thereof to removably receive the insert or commode therein with a minimum of adjustment or moving of the patient or invalid; to provide such a structure wherein the mattress is reversible permitting the recess and insert to be selectively on either side portion of the bed or support; to provide such a combination wherein the mattress support structure is movable between a first position with the mattress horizontal and a second chair-like position with one mattress end portion inclined upwardly and an other mattress end portion inclined downwardly from the from the mattress intermediate portion thereby defining a chair-like structure with the commode positioned in the intermediate portion of the mattress; to provide such a combination wherein the commode has an upper surface substantially in alignment with an upper surface of the mattress and the commode has a raised portion defining a periphery of the opening therein for use; to provide such a combination wherein the commode includes a receptacle and a removable seat portion whereby the commode is easily cleaned and sterilized; to provide such a combination wherein the utility insert is a wash basin or other receptacle for use in care of the occupant on the mattress; and to provide such a combination wherein the components are formed of durable, strong, and easily cleaned materials and are particularly well adapted for the proposed use.

Other objects and advantages of this invention will become apparent from the following description taken in connection with the accompanying drawings wherein are set forth by way of illustration and example certain embodiments of this invention.

The drawings constitute a part of the specification and include an exemplary embodiment of the present invention and illustrate various objects and features of the combination mattress, mattress insert, and commode.

Figure 1:
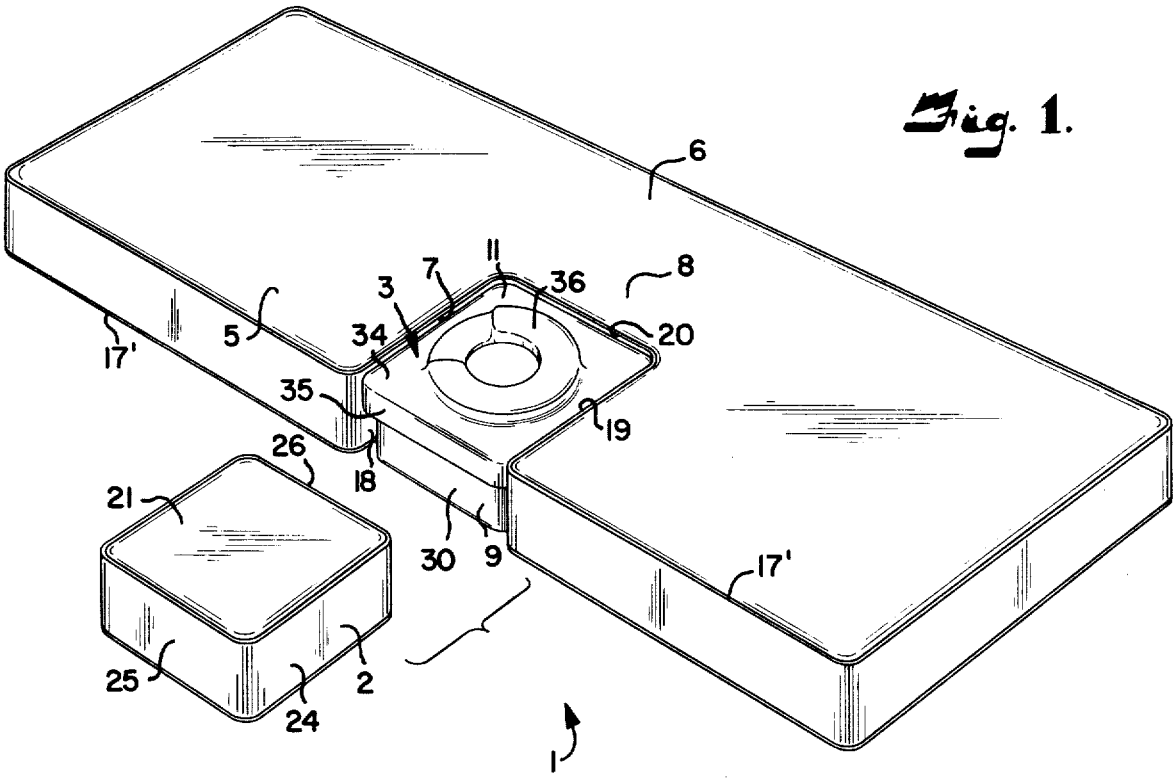
FIG. 1 is a perspective view of a combination mattress, mattress insert, and commode embodying features of the present invention.
Figure 2:
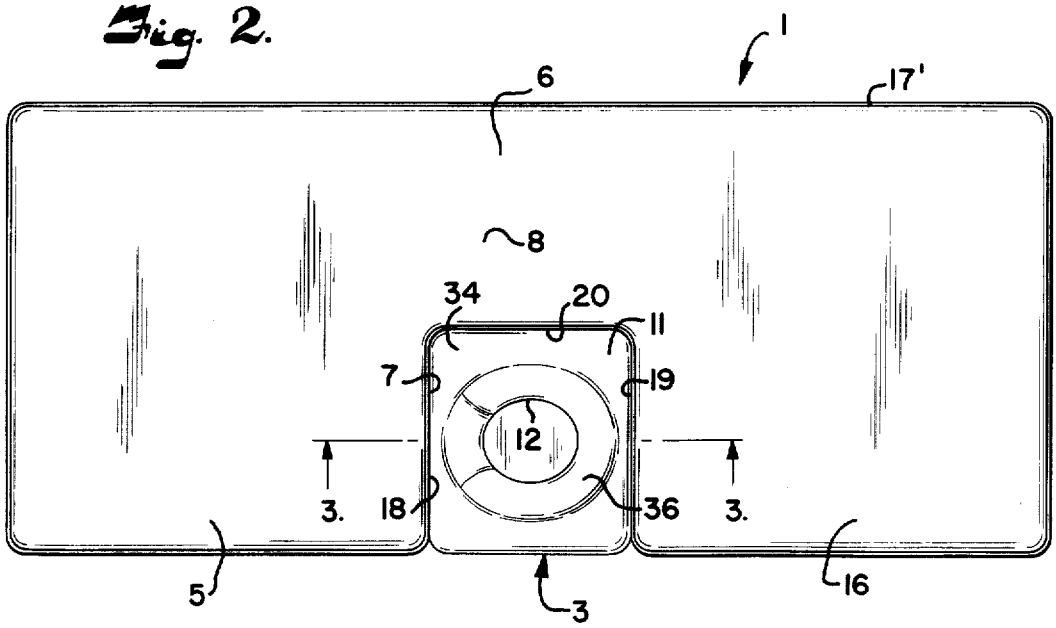
FIG. 2 is a top plan view of the mattress with the commode in place in a recess in one side edge portion of the mattress.
Figure 3:
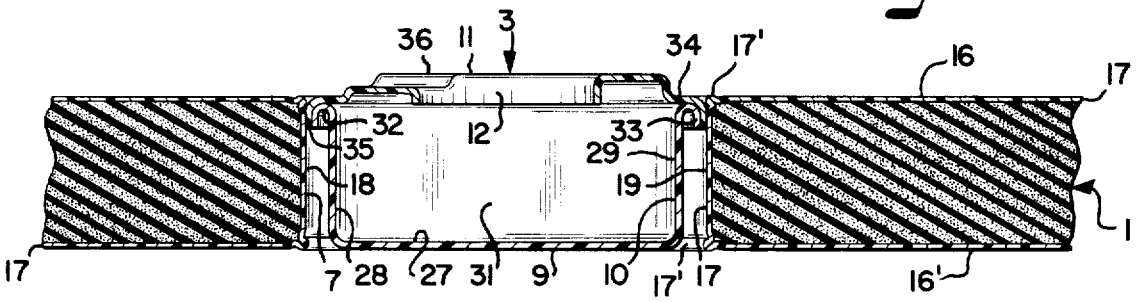
FIG. 3 is an enlarged fragmentary longitudinal sectional view taken on line 3—3 of FIG. 2 and showing construction of the commode and engagement thereof with the mattress.
Figure 4:
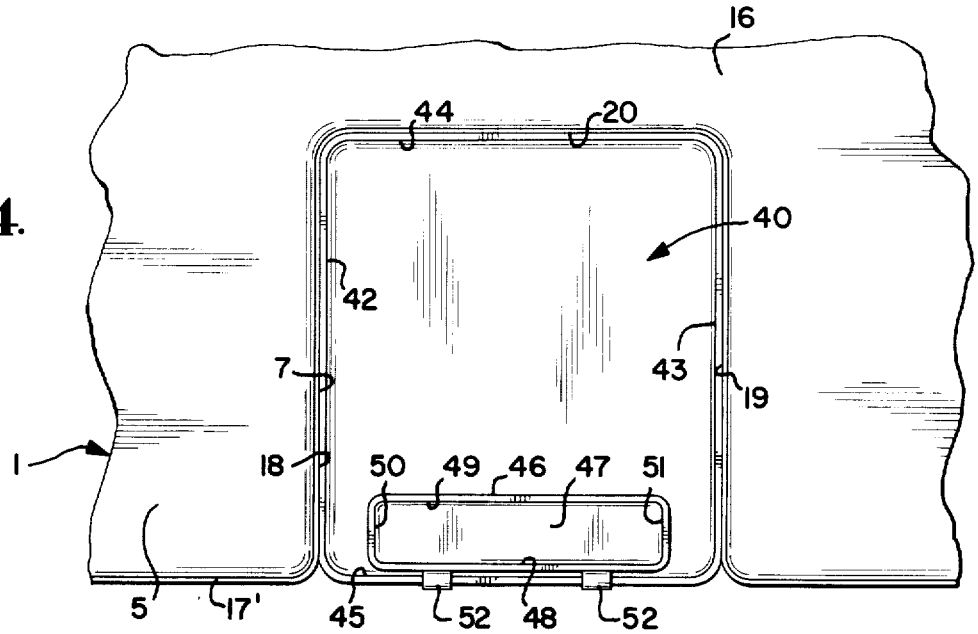
FIG. 4 is an enlarged fragmentary top plan view of the mattress with a basin in the recess in the side edge portion thereof.
Figure 5:
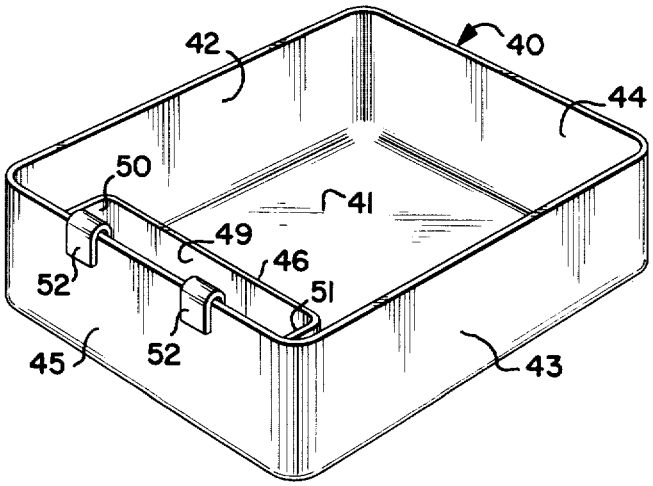
FIG. 5 is an enlarged perspective view of the basin for use in the recess in the mattress.
Figure 6:
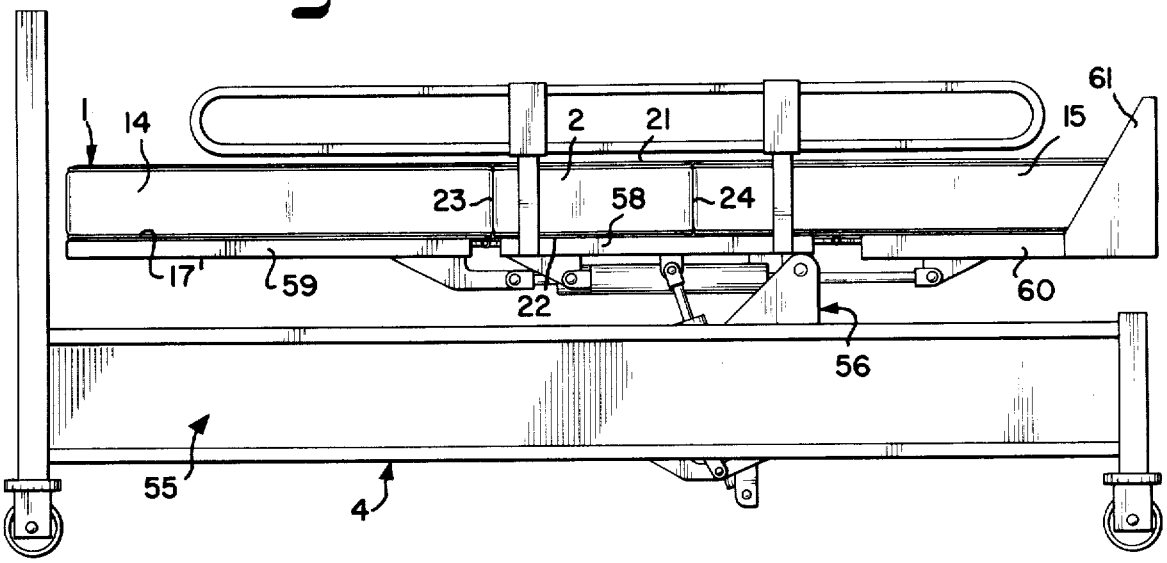
FIG. 6 is a side elevational view of a mattress support structure for use in combination with the mattress, mattress insert, and commode.
Figure 7:
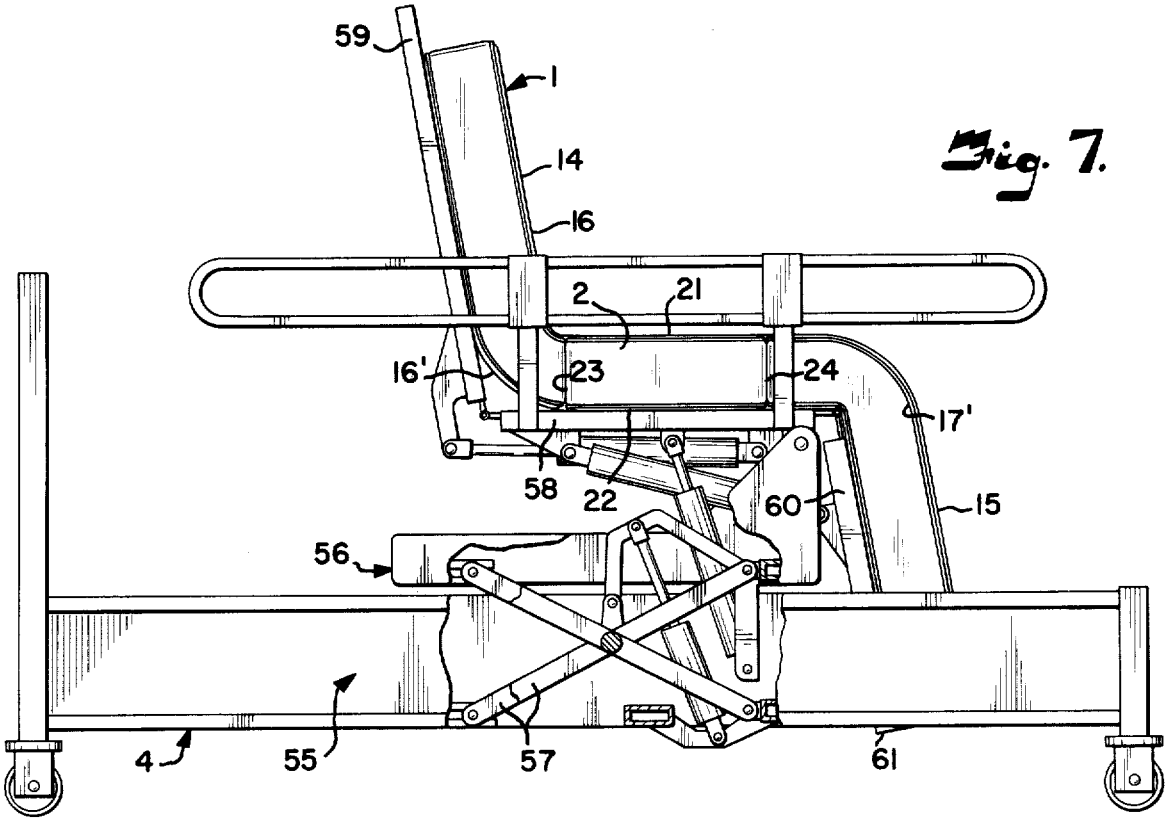
FIG. 7 is a side elevational view of the mattress support structure shown in a second chair-like position for use of the commode.

As required, detailed embodiments of the present invention are disclosed herein, however, it is to be understood that the disclosed embodiments are merely exemplary of the invention which may be embodied in various forms. Therefore, specific structural and functional details disclosed herein are not to be interpreted as limiting but merely as a basis for the claims and as a representative basis for teaching one skilled in the art to variously employ the present invention in virtually any appropriately detailed structure.

Referring more in detail to the drawings:

In the disclosed embodiment of the present invention the reference numeral 1 designates generally a mattress for use in combination with a mattress insert 2 and a utility insert 3 such as a commode, each supported on a hospital or invalid bed 4. The mattress 1 has opposite side edge portions 5 and 6 and walls extending from one of the side edge portions, for example from side edge portion 5, defining a recess 7 positioned in an intermediate portion 8 of the mattress 1 to receive either the mattress insert 2 or utility insert 3 therein. The utility insert 3 is interchangeable with the mattress insert 2 and is removably received in the recess 7 in the mattress 1. The utility insert 3 in the form of a commode has a base or receptacle 9 with an upstanding side wall 10 and a removable seat portion 11 supported on the receptacle side wall 10 and having an opening 12 therein for use. The invalid bed 4 supports the mattress 1 and one of the mattress insert 2 and utility inserts 3 when positioned in the recess 7 in the mattress 1. The bed 4 is movable between a first position having the mattress 1 horizontal and a second chair-like position having a mattress first end portion 14 inclined upwardly and a mattress second end portion 15 inclined downwardly from the mattress intermediate portion 8.

The mattress 1 may be of any suitable resilient structure and is preferably formed of foam rubber or similar resilient material that will conform to fit and support a person comfortably thereon. The mattress 1 is generally rectangular and has a first surface 16 and a second surface 16' whereby the mattress 1 is reversible to thereby position the recess 7 on the right or left side as viewed from a foot end of the invalid bed 4. The mattress 1 is preferably enclosed within a cover or envelope 17 of suitable fabric or sheet material, such as nylon, polyethylene, or the like, that is naturally or treated to be water resistant or repellant. In the structure illustrated, the mattress 1 has the cover 17 engaging the surfaces of the resilient material and said cover or envelope pieces may be connected or closed as desired as for example by rolled seams 17' or the like at all corner or edge portions.

The recess 7 in the mattress 1 is formed by facing side walls 18 and 19 extending substantially normal or perpendicular to one side edge of the mattress 1 and an end wall 20 is substantially parallel with the one side edge of the mattress and extends between the side walls 18 and 19. The end wall 20 defining the recess 7 in the mattress 1 is preferably positioned on the center-line of the mattress 1 and parallel with the side edges thereof. The mattress 1 is thereby reversible with the recess 7 being on either side of bed 4.

The mattress insert 2 is preferably of the same material as the remainder of the mattress and has the same covering to provide identical body supporting characteristics in order for the mattress and mattress insert to act and feel as one piece in supporting a person. The mattress insert 2 is generally rectangular and has a first surface 21 and a second surface 22 whereby the mattress insert 2 is reversible. The first and second surfaces 21 and 22 of the mattress insert 2 are adapted to be substantially in alignment with respective first and second surfaces 16 and 16' of the mattress 1 when in position in the recess 7.

The illustrated mattress insert 2 has opposite side edges 23 and 24 adapted to be in frictional engagement with respective side walls 18 and 19 defining the recess 7. The mattress insert 2 has opposite end edges 25 and 26 and one of the end edges is in engagement with the end wall 20 defining the recess 7 and the other end edge is in alignment with the side edge of the mattress 1 when the mattress insert 2 is in position in the recess 7. The mattress insert 2 thereby provides one-half the trasverse or lateral dimension of mattress 1 when in place in the recess 7.

The utility insert 3 or commode is interchangeable with the mattress insert 2 and is removably received in the recess 7 in the mattress 1. The receptacle 9 of the commode is formed of any suitable material adapted to withstand frequent cleaning, as by detergents, and adapted to support the weight of a person using the commode. Molded plastic, such as polyethylene, have been found to be resistant to detergents and to have strength sufficient to support a person on the seat portion 11.

The illustrated receptacle 9 includes a bottom wall 27 with the side wall 10 extending upwardly therefrom. The illustrated commode is generally rectangular with the side wall 10 having opposite side portions 28 and 29 and opposite end portions 30 and 31 extending upwardly from the bottom wall 27. The side wall 10 of the receptacle 9 has a flange 32 extending outwardly from the side portions 28 and 29 and from the end portions 30 and 31 thereby defining a support for the seat portion 11. The side wall 10 of the receptacle 9 has a wall portion 33 depending from the flanges 32 to define a substantially rigid rim adapted to strengthen the flange 32 for supporting the seat portion 11 thereon.

The seat portion 11 has an upper surface 34 adapted to be in alignment with a respective one of the first and second surfaces 16 and 17 of the mattress 1. The seat portion 11 is generally rectangular and has a peripheral edge portion with a depending lip or flange 35. The interior surface of the lip or flange 35 is adapted to be in frictional engagement with an exterior surface of the wall portion 33. The flange 35 has an exterior surface adapted to be in frictional engagement with the surface of the respective end wall 20 and the side walls 18 and 19 defining the recess 7 in the mattress 1 whereby the seat portion 11 is retained on the receptacle 9 and the commode 3 is retained in position in the recess 7 during movement of a person onto and off of the commode.

The seat portion 11 has a wall or raised portion 36 defining the opening 12 therein. The upper surface of the raised portion 36 is positioned above the upper surface 34 of the seat portion 11 and thereby above the respective first or second surface 16 and 17 of the mattress 1 when the commode is in place in the recess 7. The upper surface or raised portion 36 is similar in shape to a seat ring on a conventional toilet.

The opening 12 in the seat portion 11 is generally eliptical and one end of the wall defining the raised portion 36 has a recess in the upper surface thereof. The recess defining portion is positioned above the upper surface 34 of the seat portion 11 and below the upper surface of the raised portion 36.

A utility insert in the form of a basin 40 is adapted for use in combination with the mattress 1 and to be positioned in the recess 7 therein. The basin 40 is used for storing water, soap, and the like, for use in bathing a patient in the invalid bed 4. The illustrated basin 40 includes a bottom wall 41 having opposite side walls 42 and 43 and opposite end walls 44 and 45 extending upwardly therefrom thereby defining a generally rectangular structure. The exterior surface of the opposite side walls 42 and 43 and the exterior surface of the opposite end walls 44 and 45 are each adapted to be in frictional engagement with respective side walls 18 and 19 and the end wall 20 defining the recess 7 in the mattress 1.

A tray 46 is mounted in the basin 40 and is adapted for storage of a bar of soap, a wash cloth, rubbing alcohol, and the like. The tray 46 includes a bottom wall 47 having opposite side walls 48 and 49 and opposite end walls 50 and 51 extending upwardly therefrom thereby defining a generally rectangular structure. In the illustrated structure, one of the side walls, for example side wall 48, of the tray 46 has a pair of brackets 52 mounted on the exterior surface thereof and adapted to be supported on one of the walls defining the basin 40.

The hospital or invalid bed 4 may be any suitable structure adapted to support the mattress 1 and one of the mattress insert 2, utility insert such as a commode 3, or basin 40 when positioned in the recess 7 in the mattress 1 thereby providing a mattress support structure. The mattress support structure or bed 4 is movable between a first position having the mattress 1 generally horizontal and a second chairlike position with the mattress first end portion 14 inclined upwardly and the second mattress end portion 15 inclined downwardly from the intermediate portion 8 of the mattress 1.

The illustrated hospital bed 4 has a lower frame 55 and an upper frame 56 with a pair of laterally spaced scissor arms 57 extending therebetween and provided with suitable actuating structure to raise and lower the mattress 1. The hospital or invalid bed 4 has a center panel 58 with one end thereof pivotally supported on the upper frame 56. The mattress support structure also includes a head panel 59 and a foot panel 60 hingedly connected to respective opposite ends of the center panel 58. The foot panel 60 has a foot board 61 thereon.

In using a combination mattress, mattress insert, commode, basin, and mattress support structure as illustrated and described, the patient is moved to the full side portion of the mattress off of the mattress insert, the usual covering or bottom sheet is moved aside and the insert 2 is then removed. The commode 3 is positioned in the recess 7 in the mattress 1 and the patient is then easily moved on to the commode as it requires only sliding of the patient as there is no lifting as is necessary in the use of a conventional bed pan. The bed or mattress support structure 4 may be moved to the second or chair-like position for added convenience of the patient, the patient is again moved to the full side portion of the mattress. This may be performed with the support in the chair-like position or it may be returned to the horizontal position whichever is the easiest for the patient. After use the commode is then removed for cleaning and the mattress insert is positioned in the recess 7. The bed 4 may then be returned to the first or generally horizontal position when desired as the mattress insert 2 and utility insert 3 may be removed and inserted at any position of the bed or support wherein the intermediate portion is substantially horizontal. When it is desired to use the basin 40 for bathing, the patient is moved to the full side portion of the mattress off of the insert, the bottom sheet is then moved aside to expose the insert and the insert 2 is then removed and the basin 40 is positioned in the recess 7 in the mattress 1. This positions the basin close to the patient to facilitate use. The patient then either bathes or is bathed and the basin 40 is removed from the recess 7 and the mattress insert 2 is repositioned therein and the bottom sheet is replaced.

It is to be understood that while I have illustrated and described one form of my invention, it is not to be limited to the specific form or arrangement of parts herein described and shown.

What I claim and desire to secure by Letters Patent is:

1. In combination:

a. a mattress formed of resilient material and having opposite side edge portions and opposite end portions and an intermediate portion, one of said side edge portions at said intermediate portion having walls extending therefrom transversely of the mattress, said transverse walls being connected by a longitudinal wall cooperating therewith and defining a laterally extending recess in the mattress for substantially one-half the width thereof;

b. a mattress insert formed of the same resilient material as the mattress and substantially corresponding in shape and size to said recess and removably received in said recess in said mattress and having side walls and an end wall frictionally engaged with the transverse walls and longitudinal wall defining said recess;

c. a utility insert interchangeable with said mattress insert and removably received in said recess in said mattress, said utility insert having a receptacle with side wall portions engaging the recess defining walls;

d. said utility insert having a removable cover supported on said side wall portions of said receptacle;

e. said side wall portions of said receptacle having an upper edge portion formed to define a rim;

f. said cover having a peripheral edge portion with a depending flange surrounding and in engagement with said upper edge portion of said receptacle side wall portions; and g. said depending flange of said edge portion of said cover having an exterior surface adapted to be in frictional engagement with said walls defining said recess in said mattress.

2. In combination as set forth in claim 1 wherein:

a. said utility insert comprises a commode and the removable cover is supported on said side wall portions of said receptacle, said removable cover has a seat portion with an opening therein for use;

b. said mattress has a first surface and a second surface and is invertable to selectively position the side having the recess;

c. said mattress insert has a first surface and a second surface each substantially in alignment with a respective one of said first and second surfaces of said mattress when positioned in said recess in said mattress; and d. said removable cover of said commode has an upper surface substantially in alignment with a respective one of said first and second surfaces of said mattress when positioned in said recess in said mattress.

3. In combination as set forth in claim 2 wherein:

a. said removable cover of said commode has a raised portion defining the seat portion and a periphery of the opening therein;

b. the opening in said seat portion is generally elliptical and one end of the raised portion defining same is recessed; and c. the raised portion defining the seat portion and opening in said removable cover of said commode has an upper surface positioned above one of the first and second surfaces of said mattress when positioned in the recess of said mattress.

4. In combination:

a. a mattress formed of resilient material and having opposite side edge portions and opposite end portions and an intermediate portion, one of said side edge portions at said intermediate portion having walls extending therefrom transversely of the mattress, said transverse walls being connected by a longitudinal wall cooperating therewith and defining a laterally extending recess in the mattress for substantially one-half the width thereof;

b. a mattress insert formed of the same resilient material as the mattress and substantially corresponding in shape and size to said recess and removably received in said recess in said mattress and having side walls and an end wall frictionally engaged with the transverse walls and longitudinal wall defining said recess;

c. a utility insert interchangeable with said mattress insert and removably received in said recess in said mattress, said utility insert having a receptacle with side wall protions engaging the recess defining walls;

d. a mattress support structure adapted to support said mattress and one of said mattress insert and said utility insert when positioned in said recess in said mattress, said mattress support structure being movable between a first position having said mattress horizontal and a second position having one end portion of said mattress inclined upwardly and the other end portion of said mattress inclined downwardly from said intermediate portion;

e. said utility insert comprises a commode having a removable cover supported on said side wall portions of said receptacle, said removable cover having a seat portion with an opening therein for use;

f. said receptacle of said commode having a bottom wall engageable with said mattress support structure when positioned in said recess in said mattress;

g. said side wall portions of said receptacle having an upper edge portion formed to define a rim;

h. said removable cover of said commode having a peripheral edge portion with a depending flange surrounding and in engagement with said upper edge portion of said receptacle side wall portions; and i. said depending flange of said edge portion of said removable cover having an exterior surface adapted to be in frictional engagement with said walls defining said recess in said mattress.

5. In combination as set forth in claim 4 wherein:

a. said mattress has a first surface and a second surface with one of said first and second surfaces being in engagement with said mattress support structure, said mattress being invertable to selective position the side having the recess:

b. said mattress insert has a first surface and a second surface wach substantially in alignment with a respective one of said first and second surfaces of said mattress when positioned in said recess in said mattress;

c. said removable seat portion of said commode has an upper surface substantially in alignment with a respective one of said first and second surfaces of said mattress when positioned in said recess in said mattress.

6. In combination as set forth in claim 5 wherein:

a. said removable cover of said commode has a raised portion defining the seat portion and a periphery of the opening therein;

b. the opening in said seat portion is generally elliptical and one end of the raised portion defining same is recessed; and c. the raised portion defining the seat portion and opening in said removable cover of said commode has an upper surface positioned above one of the first and second surfaces of said mattress when positioned in the recess of said mattress.

* * * * *